US005175236A

United States Patent [19]

Irwin

[11] Patent Number: 5,175,236

[45] Date of Patent: Dec. 29, 1992

[54] TOUGH, HIGH STRENGTH FIBERS OF COPOLYESTERS PREPARED FROM ISOPHTHALIC ACID; 4,4'-OXYDIBENZOIC ACID; AND HYDROQUINONE DIACETATE

[75] Inventor: Robert S. Irwin, Wilmington, Del.

[73] Assignee: E. I. Du Pont de Nemours and Company, Wilmington, Del.

[21] Appl. No.: 683,052

[22] Filed: Apr. 10, 1991

[51] Int. Cl.[5] ..... C08G 63/00; C08G 63/02; C08G 63/18; C08G 67/00

[52] U.S. Cl. ..... 528/272; 528/176; 528/193; 528/194; 528/271

[58] Field of Search ..... 528/176, 193, 194, 271, 528/272

[56] References Cited

U.S. PATENT DOCUMENTS

| | | | |
|---|---|---|---|
| 4,118,372 | 10/1978 | Schaefgen | 528/190 |
| 4,247,514 | 1/1981 | Luise | 528/193 |
| 4,904,756 | 2/1990 | Quentin | 528/193 |

FOREIGN PATENT DOCUMENTS 1-115926 5/1989 Japan .

*Primary Examiner*—John Kight, III
*Assistant Examiner*—T. Mosley

[57] ABSTRACT

Tough, high strength fibers of copolyesters from hydroquinone, isophthalic acid and 4,4'-oxydibenzoic acid in defined proportions.

1 Claim, No Drawings

TOUGH, HIGH STRENGTH FIBERS OF COPOLYESTERS PREPARED FROM ISOPHTHALIC ACID; 4,4'-OXYDIBENZOIC ACID; AND HYDROQUINONE DIACETATE

BACKGROUND OF THE INVENTION

High strength, high modulus fiber such as Kevlar® aramid fiber is well-accepted in industry for use in composites of various sorts. Liquid crystal polyester fibers have been known for many years (see U.S. Pat. No. 4,118,372). Heat treated, they too generally exhibit a relatively high tenacity and modulus. For some end-use applications, high modulus is not a requirement and in certain cases, e.g., fishing lines, low modulus fiber is definitely preferred. In some of these applications, greater toughness is the quality sought. The present invention is directed to this need.

SUMMARY OF THE INVENTION

The present invention provides high tenacity, high toughness fibers of a copolyester comprising the following repeat units:

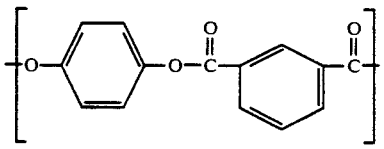

I

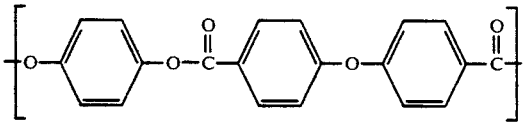

II where unit I is present in the range of from about 60 to 80 mol percent and unit II is present in the range of from about 20 to 40 mol percent.

DESCRIPTION OF THE INVENTION

The combination of high tenacity and high toughness in liquid crystal polyester fibers is unusual. The present invention focuses on a copolyester based on hydroquinone, isophthalic acid and 4,4'-oxydibenzoic acid in a limited range of proportions. Outside this range, melting points become excessively high and anisotropy is lost or the desired tenacity and toughness properties are not achieved. Within the range, the copolyesters are melt-spinnable and after being spun, may be heat-strengthened in the manner well known for liquid crystal polyester fibers. The copolyester of fibers of this invention comprises the following repeat units:

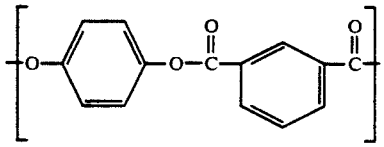

I

-continued

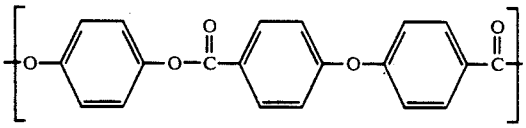

II in the proportions of from about 60 to 80 mol percent of unit I and from about 20 to 40 mol percent of unit II.

The polymers are prepared by conventional techniques (see Schaefgen U.S. Pat. No. 4,118,372). More specifically, hydroquinone diacetate is reacted with a mixture of isophthalic and 4,4'-oxydibenzoic acid in the desired proportions and polymerization is continued until a polymer of fiber forming molecular weight is achieved. An inherent viscosity of at least 0.45 measured as described below is satisfactory. The resulting polymer is melt-spun and then heat strengthened by procedures well-known in the art. (See Luise U.S. Pat. No. 4,183,895).

MEASUREMENT AND TEST PROCEDURES

Tenacity, (T) in grams per denier (gpd); elongation, (E) in percent; modulus (M) in grams per denier (gpd) and toughness (To) in grams per denier (gpd) are measured as follows:

The fibers are conditioned at 21° C. (70° F.) and 65% relative humidity. Single filaments are tested on a conventional tensile tester using a 2.5 cm (1.0 inch) gauge length at a 10%/min. strain rate. T and E are measured at break; M is the initial modulus; and $T_o$ is the area under the stress-strain curve.

$$\text{Inherent viscosity, } \eta_{inh} = \frac{\ln(\eta_{rel})}{C}$$

where $\eta_{rel}$ is the relative viscosity and C is the concentration in grams of polymer per deciliter of solvent, typically 0.5 g in 100 ml. (Thus, the units for inherent viscosity are dl/g.) The relative viscosity, $\eta_{rel}$, is determined by dividing the flow time of the dilute solution in a capillary viscometer by the flow time for the pure solvent. The flow times are determined at 30° C. The solvent employed is a mixed solvent consisting of 7.5% trifluoroacetic acid, 17.5% methylene chloride, 12.5% dichlorotetrafluoroacetone hydrate, 12% perchloroethylene and 50% 4-chlorophenol.

Melting curves were obtained on a Du Pont 1090 Differential Scanning Calorimeter (DSC) at 20° C./min. heating rate. The peak temperature of the melting endotherm was determined. The width of the peak indicates the melting range.

The following examples, except for Example 4, are illustrative of the invention and are not intended as limiting. Examples 1–4 show preparation and spinning of polymer that comprises

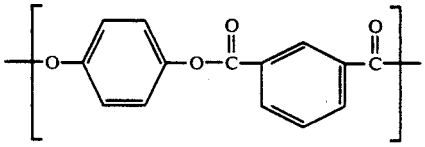

units, also referred to as PG-I and

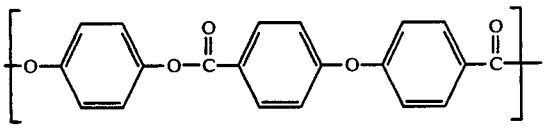

units, also referred to as PG-BOB. In the examples, the proportions vary from 50 to 80 mol percent PG-I, the remainder being PG-BOB. The fibers are then heat-strengthened.

EXAMPLE 1

In a 100 ml three-necked, round-bottomed flask equipped with a stirrer, dry nitrogen purge, provision for heating by a Wood's metal bath, and provision for attachment to a high vacuum pump with a cold finger to freeze out any volatiles, a mixture of 20.37 g hydroquinone diacetate (0.105 mole), 9.96 g isophthalic acid (0.060 mole) and 4,4'-oxydibenzoic acid (10.48 g, 0.040 mole) was heated from 230° C. to 340° C. progressively during 70 min., then at 340° C. during 10 minutes at a pressure of 0.5 mm mercury. Inherent viscosity was 0.62 (measured in a mixture consisting of 7.5% trifluoroacetic acid, 17.5% methylene chloride, 12.5% dichlorotetrafluoroacetone hydrate, 12% perchloroethylene, and 50% 4-chlorophenol. DSC showed a melting endotherm peak at 307° C. (range 290°-325° C.); fiber stick temperature was 315° C. Between crossed polarizers, under the microscope it became soft and birefringent at 300° C. Anisotropy disappeared in the range 320°-330° C. Beyond 330° C., to at least 350° C., the melt was strongly shear anisotropic.

A molded cylindrical plug of the polymer, heated to 322° C., was extruded through a set of screens (2×50 mesh, 2×100 mesh, 2×200 mesh, 2×325 mesh, 2×50 mesh) through a single spinneret hole, 0.23 mm (0.009 inch) diameter×0.69 mm (0.027 inch) length, heated at 324° C. A lustrous fiber was wound up at 600 ypm. The fiber was heat-strengthened in an oven with a slow purge of nitrogen by heating progressively from 200°-305° C. during 3 hr, and held 7 hr at 305° C. Average T/E/Mi/To/den was 15.1 gpd/8.3%/90 gpd/0.48 gpd/0.8 den. Highest value was 18.7/8.2/104/0.58/1.0.

EXAMPLE 2

Polymer of $\eta_{inh}=0.62$ was obtained by the procedure of Ex. 1 but using about 0.070 moles of isophthalic acid and 0.030 moles of 4,4'-oxydibenzoic acid per 0.105 mole of hydroquinone diacetate. It softened at 300° C. and melted at 325° C. to a melt wherein the anisotropic phase progressively disappeared in the temperature interval 330°-350° C. Above 350° C. the melt was highly shear anisotropic. Fibers could be pulled from the melt at 345° C.

As described in Ex. 1, polymer at about 350° C. was extruded to a fiber which after heat-treatment as in Example 1 gave average T/E/Mi/To/den=15/8/135/0.51/3.8. Best break was 17.1/8.0/143/0.61/4.4. The stress-strain curve, convex before heat treatment, was mildly concave after heat treatment.

EXAMPLE 3

As in Ex. 1, polymer of $\eta_{inh}=0.53$ was prepared using about 0.08 moles of isophthalic acid and 0.020 moles of 4,4'-oxydibenzoic acid per 0.105 mole of hydroquinone diacetate. It appeared to melt on the hot bar at 340° C. and yielded fibers at 370° C. DSC showed distinct melting endotherm at 350° C. Between crossed polarizers at 350° C., it appeared to be a mixture of anisotropic and isotropic phases; the former disappeared at about 365° C. On cooling, the anisotropic phase did not reappear. Above 365° C. shear anisotropy was modest.

Fibers extruded at 350°-360° C. wound up at 600 ypm had average T/E/Mi/To/den=1.0/39/30/0.32/4.4; the stress-strain curve had a distinct convex "knee". After heat treatment as in Example 1 but up to 310° C., the stress-strain curve became mildly concave; T/E/Mi/To/den=11.6/11.8/58/0.52/5.0.

EXAMPLE 4

Comparative Example

As in Ex. 1, polymer of $\eta_{inh}=0.74$ was prepared using about 0.050 moles of isophthalic acid and 0.050 1moles of 4,4'-oxydibenzoic acid per 0.105 mole of hydroquinone diacetate. It melted at 335° C. (DSC) and showed melt anisotropy up to 370° C. Above 370° C. it was highly shear anisotropic. Fibers were extruded at about 350° C. and wound up at 600 ypm. Heat treatment as in Example 1 to a maximum of 305° C. gave average T/E/Mi/To/den=5.3/7.0/78/0.17/3.8.

I claim:

1. High tenacity, high toughness fibers of a copolyester comprising the following repeat units:

I

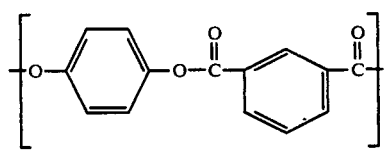

II

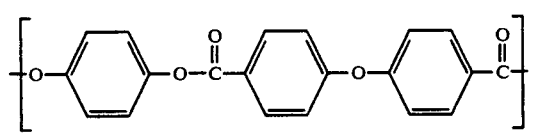

where unit I is present in the range of from about 60 to 80 mol percent and unit II is present in the range of from about 20 to 40 mol percent.

* * * * *